United States Patent [19]

Usner

[11] Patent Number: 4,779,746

[45] Date of Patent: Oct. 25, 1988

[54] MULTIPLE GARMENT HANGER STORAGE AND SORTING DEVICE

[76] Inventor: Daniel C. Usner, 9535 Greystone Pkwy., Brecksville, Ohio 44141

[21] Appl. No.: 142,570

[22] Filed: Jan. 11, 1988

[51] Int. Cl.[4] ..... A47F 7/19

[52] U.S. Cl. ..... 211/124; 211/7

[58] Field of Search ..... 211/7, 8, 123, 124, 211/105.1; 206/279, 289, 290, 291

[56] References Cited

U.S. PATENT DOCUMENTS

| | | | |
|---|---|---|---|
| 1,506,335 | 8/1924 | Brown | 211/124 X |
| 2,980,260 | 4/1961 | Richer | 211/124 |
| 3,490,599 | 1/1970 | Von Maur | 211/49.1 |
| 4,139,102 | 2/1979 | Winton | 211/7 X |

*Primary Examiner*—Robert W. Gibson, Jr.

*Attorney, Agent, or Firm*—Milton L. Simmons

[57] ABSTRACT

There is provided a tubular, self-locking, garment hanger device of chocleate cross-section, and being an essentially unitary, plastic resin extrusion.

6 Claims, 1 Drawing Sheet

MULTIPLE GARMENT HANGER STORAGE AND SORTING DEVICE

Figure 1:
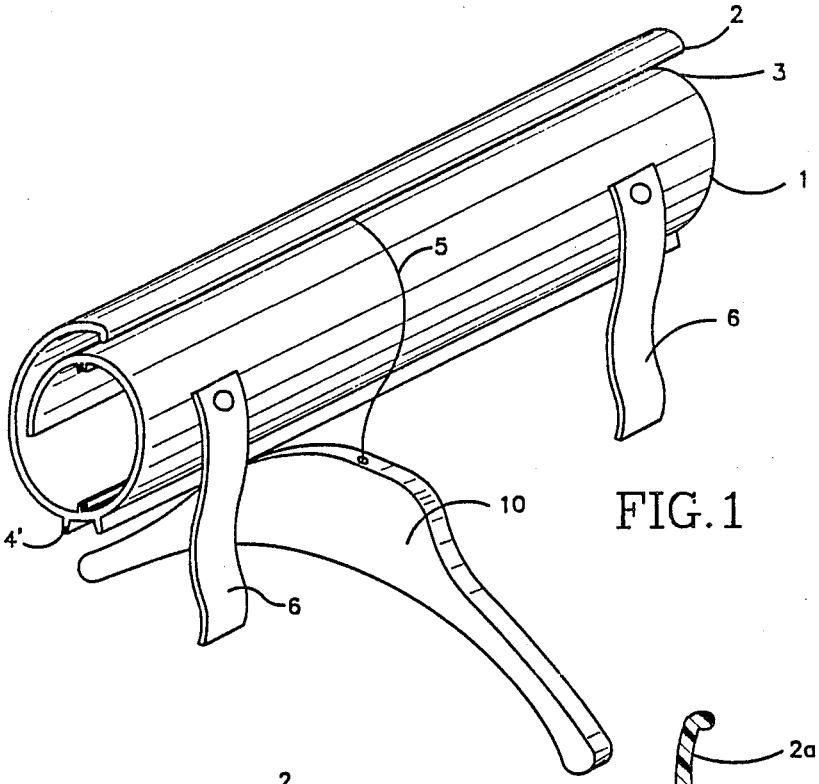

With but minor variations, the distribution of hanger-hung clothing has become fairly standardized. Generally, the large retail outlets maintain appropriately located warehousing and regional distribution centers, servicing a number of retail outlets. These warehousing and distribution centers receive the clothing from the principal supplier, where it is sorted according to size, style, etc. and tagged with price and size information and, where applicable, bar-coded.

From the distribution center, the sorted clothing is trucked, in the "hanging" mode, to various outlets for sale to the purchasing public. As the trade has developed, from the time the garment leaves the manufacturer, through all its intermediate destinations, it is maintained in "rack ready" condition, which in effect means that the garment is on a hanger, and will be, until it is sold at a retail outlet.

Usually, the manufacturer of the garment utilizes a relatively cheap, disposable, and therefore fragile, plastic garment hanger. At some point in its journey to the final, retail outlet, a sturdier, more durable and recyclable garment hanger will be substituted for the cheap one, which will be discarded. When the garment is finally sold at a retail outlet, the recyclable garment hanger is removed from it and is eventually utilized again as a replacement for the relatively cheap, expendable plastic hangers relied upon by the garment manufacturer.

It is in the storing and recycling of garment hangers, wherein the problem has been created, which the instant invention alleviates to a great extent. That is, garment retail outlets have determined that one of the most inefficient uses of salespeople's time stems from efforts to dientangle, sort and recycle garment hangers.

Until now, the classic method of handling garment hanger recycling was to simply throw the hangers into a large, empty box, positioned in the vicinity of the wrapping desk. When the box was full, it would be manually lugged to the rear of the retail outlet, or trucked back to the distribution center, if that is where the hanger "switch" was to take place. So at some point, some individual, or group of individuals, were required to painstakingly attempt to disentangle the spaghetti-like, interlocked, jumble of hanger hooks they were confronted with.

The device of the instant invention provides a relatively inexpensive, though highly effective, means for storing garment hangers, when they are removed from a garment at the retail wrapping desk, in such a way that they are literally presorted, permitting them to be put back into service effortlessly, eliminating the time-consuming, disentangling operation.

Figure 2:
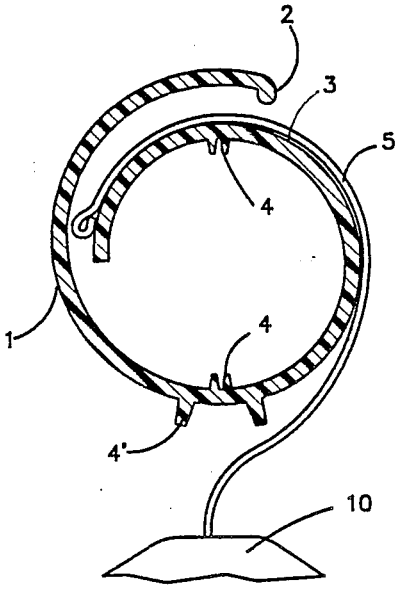
Figure 3:
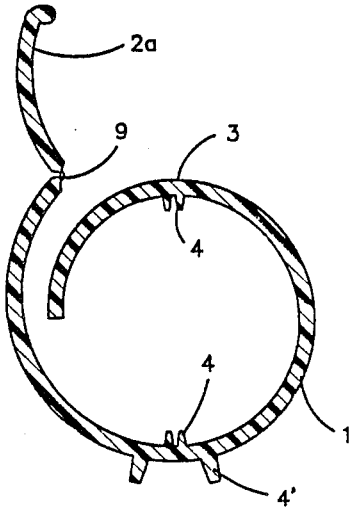
Figure 4:
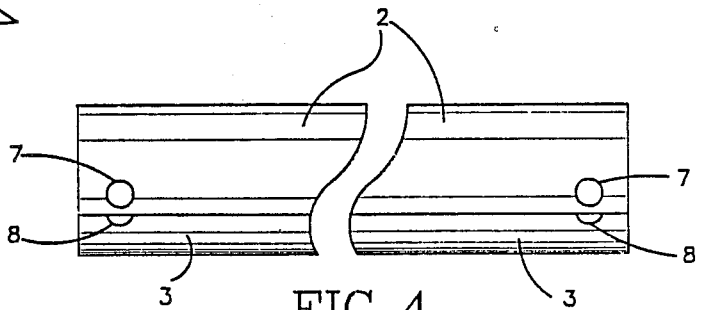

Referring now to the drawings attached hereto, and made a part hereof:

FIG. 1 is a perspective view of the device of this invention showing a single garment hanger engaged by said device; and, FIG. 2 is a cross-section of the device of FIG. 1, taken at random at any point, showing a typical hook of an engaged hanger; and, FIG. 3, similarly to FIG. 2, is a random cross-section of a slight variation of the device of FIG. 1; and, FIG. 4 is a foreshortened, plan view of the device of FIG. 1, and which is slight variation of the device of FIG. 1.

By way of explaining the operation of the instant device, reference may now be made to FIG. 1, disregarding for the moment retaining straps 6. In effect, the device of FIG. 1 is simply an elongated, helical, synthetic plastic resin extrusion which, for purposes of this specification, shall be referred to as a generally tubular, elongate garment hanger storing and locking device, having a generally cochleate cross-section. As will be seen from FIG. 2, its cross-section is generally formed so as to roughly coincide with the hook 5, of garment hanger 10.

The preferred synthetic resin from which the device of FIG. 1, generally designate by reference numeral 1, is manufactured, is acrylo butadiene styrene, which is a thermoplastic resin having good strength, and rigidity. By any number of means and devices, all known in the art, a die having generally the configuration of the cross-sections of the instant device depicted in either FIG. 2 or FIG. 3 hereof, may be formed, whereby the device of this invention, depicted in any of the FIGS. hereof, may be continuously extruded and cut into convenient lengths as a matter of choice.

Although acrylo butadiene styrene is the preferred resin for the manufacture of the instant device, any number of rigid, or simi-rigid, thermoplastic resins could be utilized, such as styrene acrylonitrile, to extrude the device of the instant invention. However, it must be understood, that a thermoplastic resin would not be absolutely essential to the manufacture of the device of the instant invention. For example, various metals, such as certain alloys of aluminum, could quite likely be utilized to fashion the device of the instant invention.

However, it has been found that a rigid, or simi-rigid thermoplastic resin is best suited for the purpose for reasons of economy, plus the fact that, by slighly varying the thickness of various segments of the crosssection, and building in optional reinforcing, longitudinal ribs, the inherent rigidity of the material can be utilized to good effect to prevent sagging of the device under the load of a multiplicity of garment hangers, while at the same time, a certain amount of flexibility, and spring-like tension, may be built into the device so that hanger hooks may be forced into position as shown, and held snugly by the overlapping member 2 of the device, to prevent inadvertent displacement of the garment hangers until such time as they are ready to be used again, as part of the recycling process.

In operation, the device of FIG. 1, generally designated by numeral 1, may be hung or suspended by any number of means, one of which will be hereinafter described, at or in the vicinity of a wrapping desk. When the salesperson removes garment hanger 10, having hook 5, from the garment, it may be quickly and easily forced into position on the device of the instant invention as depicted in FIGS. 1 and 2. Note in FIGS. 2 and 3, internal linear reinforcing ridges 4, and exterior reinforcing ridges 4' have been built into the device, as part of the extrusion, to provide end-to-end rigidity to thereby resist sagging under a load of garment hangers. Note, referring to FIG. 2, that the device is characterized by an outer terminal flange 2, overlapping, in close, spaced relationship, an adjacent, inner convolute surface 3 of said device, which results in a linear opening created thereby, between the edge of said outer flange and the adjacnet surface of said inner, convolute surface 3. It is the inner, convolute surface 3, which primarily bears the weight of garment hanger 10 via its hook 5, when the device is in a horizontal attitude as depicted by the drawings.

It should be noted however, that for initial storing purposes, a length of the instant device may be held in a vertical position by a length of a tubular member firmly fixed to the floor, whereby the device of this invention is slid over the vertical support member, like a sleeve. Hangers slipped onto the vertical device are held in a vertical stack by combination of gravity and my device. When full, the loaded device may be lifted and transported horizontally.

Now, due to the inherent limited flexibility of outer terminal flange 2, in cross-section, it may be extruded in such a way that it is literally, temporarily forced upwardly when a hanger hook is jammed into position, then snugly comes back to rest on top of a hanger hook to thereby function as a restraint against inadvertent displacement and dislodgement from the ends of my device.

However, as will be readily seen, any number of supplementary means may be employed, particularly at the ends of the device, for forcing terminal flange 2 down more firmly into locking position on top of stored hanger hooks 5. For example, when the device is loaded and ready to be returned to the recycling point, a number of rubber bands could be tightly wound around each end of the device. In the device shown in FIG. 1, Velcro straps 6 have been affixed in the position shown. As is well known, Velcro is a commonly-used fastening device whereby two "hook and eye" surfaces will firmly adhere to each other when pressed into snug contact, though which may be readily stripped apart when sufficient tension is applied. In the device shown, a strip of female Velcro may be sewn on one surface of retaining strap 6, with a stretch of male Velcro stitched to the reverse side so that, when the strap is wrapped around the device shown, and overlapped upon itself, it may be tightened to any reasonable degree and fastened to itself, to thereby snugly press outer terminal flange 3 downwardly into locking relationship, vis-a-vis hanger hooks 5.

Straps 6 also serve another function, in that they can be wrapped loosely around each end of the device during the period it is being filled with hangers, to thereby prevent lateral displacement of garment hangers from either end of the device.

Referring to FIG. 4, it depicts a relatively simple, practical variation of the device, whereby it may be readily hung horizontally in the vicinity of the wrapping desk, while at the same time providing end means to the device to prevent inadvertent spillage of garment hangers from the ends of the device.

As will be seen from FIG. 4, the slightly modified device 3 has had holes 7 drilled through outer terminal flange 2, with holes 8 below slightly offset, having been drilled through inner convolute surface 3. By very slightly squeezing the device in the vicinity of the holes, holes 7 and 8 can be made to coincide and to register with each other, to thereby permit a simple, elongated hook, with a retaining collar on the shank thereof, to be passed through said holes, for hanging in the vicinity of a wrapping desk to thereby suspend the device of FIG. 4. The shank of the hooks passing through the holes 7 and 8 also act as an effective deterrent to end-displacement of the hangers from the device of this invention. But again, the device of FIG. 4 is simply a variation on the basic device, the offset holes functioning as an aid to achieving its principal purpose.

FIG. 3 is another variation of the device shown in FIGS. 1 and 2 in that the extruder die has been modified slightly to produce an extremely thin section at the point designated by 9, thereby creating what might be best called a "living hinge," whereby outer terminal flange 2*a* is more easily lifted to permit the insertion of hanger 5.

In the device of FIG. 2, outer terminal flange 2, because of its proximity to inner convolute surface 3, and its relatively uniform thickness, constitutes suitable means for urging said terminal flange firmly downwardly against said hanger hooks. That is, if terminal flange 2 is optionally extruded so as to be in close proximity to inner convolute surface 3, it may thereby, in and of itself, constitute sufficient means for urging itself downwardly in snug relationship to hanger hook 5.

However, depending upon the thinness of living hinge 9, an the corresponding degree of flexibility, or lack of rigidity, of hinged terminal flange 2*a*, separate means might well be required, such as described above, to urge termnal flange 2*a* down into snug relationship vis-a-vis hanger hook 5. All such variations are within the purview of this invention.

I claim:

1. A unitary, generally tubular, elongate garment hanger storing and locking device, having a generally cochleate cross-section, said device having an outer terminal flange overlapping, in spaced relationship, an adjacent, inner convolute surface of said device, with a linear opening created between the edge of said outer flange and said adjacent, inner convolute surface, said opening adapted to receive a plurality of garment hanger hooks in sung, overlapping relationship, and said inner, convolute surface adapted to support the crook of said garment hanger hooks.

2. The device of claim 1 which is formed as an extrusion of a thermoplastic, synthetic resin.

3. The device of claim 1 having a continuous, living hinge the length of its outer, overlapping, terminal flange.

4. The device of claim 1 which is formed as an extrusion of a synthetic, thermoplastic resin selected from the group consisting of acrylo butadiene styrene and styrene acrylonitrile.

5. A unitary, generally tubular, elongate garment hanger storing and locking device, having a generally cochleate cross-section, said device having an outer terminal flange overlapping, in spaced relationship, an adjacent, inner convolute surface of said device, with a linear opening created between the edge of said outer flange and said adjacent, inner convolute surface, said opening adapted to receive a plurality of garment hanger hooks in snug, overlapping relationship, and said inner, convolute surface adapted to support the crook of said garment hanger hooks, plus means for preventing end disengagement of garment hangers, and means for urging said terminal flange firmly downwardly against said hanger hooks.

6. The device of claim 4 wherein the means for urging said terminal flange downwardly against said hanger hooks are two or more tying devices wrapped tightly around said device.

* * * * *